US009328707B2

(12) United States Patent
Rodriguez-Amaya et al.

(10) Patent No.: US 9,328,707 B2
(45) Date of Patent: May 3, 2016

(54) FUEL INJECTOR

(75) Inventors: Nestor Rodriguez-Amaya, Stuttgart (DE); Siegfried Ruthardt, Altdorf (DE); Holger Rapp, Ditzingen (DE); Wolfgang Stoecklein, Waiblingen (DE); Bernd Berghaenel, Illingen (DE); Marco Beier, Stuttgart-Feuerbach (DE)

(73) Assignee: Robert Bosch GmbH, Stuttgart (DE)

( * ) Notice: Subject to any disclaimer, the term of this patent is extended or adjusted under 35 U.S.C. 154(b) by 218 days.

(21) Appl. No.: 13/519,085

(22) PCT Filed: Dec. 3, 2010

(86) PCT No.: PCT/EP2010/068828

§ 371 (c)(1),
(2), (4) Date: Jun. 25, 2012

(87) PCT Pub. No.: WO2011/085867

PCT Pub. Date: Jul. 21, 2011

(65) Prior Publication Data

US 2012/0325936 A1 Dec. 27, 2012

(30) Foreign Application Priority Data

Jan. 12, 2010 (DE) ..... 10 2010 000 827

(51) Int. Cl.

| | |
|---|---|
| ***F02M 59/00*** | (2006.01) |
| ***F02M 57/00*** | (2006.01) |
| ***F02M 47/02*** | (2006.01) |
| ***F02M 63/00*** | (2006.01) |

(52) U.S. Cl.

CPC ..... *F02M 57/005* (2013.01); *F02M 47/027* (2013.01); *F02M 63/004* (2013.01); *F02M 63/0015* (2013.01); *F02M 63/008* (2013.01); *F02M 63/0033* (2013.01); *F02M 2200/304* (2013.01); *F02M 2547/003* (2013.01)

(58) Field of Classification Search

USPC ..... 239/533.1–533.15, 585.5; 123/476

See application file for complete search history.

(56) References Cited

U.S. PATENT DOCUMENTS

| | | | | |
|---|---|---|---|---|
| 5,979,803 | A | 11/1999 | Peters et al. | |
| 6,598,591 | B2 * | 7/2003 | Lewis | 123/467 |
| 6,712,047 | B2 | 3/2004 | Rueger | |

(Continued)

FOREIGN PATENT DOCUMENTS

| | | |
|---|---|---|
| DE | 102005054927 | 5/2007 |
| DE | 102006055486 A1 * | 5/2008 |

(Continued)

OTHER PUBLICATIONS

PCT/EP2010/068828 International Search Report, 2 pages.

(Continued)

*Primary Examiner* — Len Tran
*Assistant Examiner* — Adam J Rogers
(74) *Attorney, Agent, or Firm* — Michael Best & Friedrich LLP

(57) ABSTRACT

The invention relates to a control chamber, the pressure of which determines the strokes or positions of a nozzle needle, and which is assigned to a force or pressure sensor in order to detect the progression of the control chamber pressure. Because the control chamber pressure significantly changes during the closing of the nozzle needle, the operating phases of the injector can be exactly determined from the sensor data and supplied to an engine controller.

8 Claims, 2 Drawing Sheets

(56) References Cited

U.S. PATENT DOCUMENTS

| | | | | |
|---|---|---|---|---|
| 7,865,293 | B2 | 1/2011 | Ishizuka et al. | |
| 8,061,329 | B2 | 11/2011 | Pursifull et al. | |
| 2010/0096480 | A1 | 4/2010 | Kondo et al. | |
| 2010/0263633 | A1 | 10/2010 | Kondo et al. | |
| 2011/0214643 | A1 | 9/2011 | Blizard et al. | |
| 2012/0031376 | A1 * | 2/2012 | Magel | F02M 57/005 123/445 |

FOREIGN PATENT DOCUMENTS

| | | | | |
|---|---|---|---|---|
| WO | 9835210 | | 8/1998 | |
| WO | WO 2007132199 | A1 * | 11/2007 | |
| WO | 2009071472 | | 6/2009 | |
| WO | 2010127889 | | 11/2010 | |
| WO | WO 2010127889 | A1 * | 11/2010 | F02M 57/005 |

OTHER PUBLICATIONS

PCT International Search Report for Application No. PCT/EP2010/053081 dated Apr. 22, 2010, 3 pages.

United States Patent Office Action for U.S. Appl. No. 13/263,957 dated Dec. 4, 2014 (8 pages).

* cited by examiner

FUEL INJECTOR

BACKGROUND OF THE INVENTION

The invention relates to fuel injectors having injection nozzles controlled by a nozzle needle or the like, and having a control chamber, which communicates with a high- and a low-pressure side of the injector, which is designed as a working chamber of a displacer coupled to the nozzle needle for driving, and which is switched by means of a control valve arrangement between a closing pressure, at which the nozzle needle is set to the closed position thereof by the displacer, and an opening pressure, at which the nozzle needle, together with the displacer, moves into the open position.

In the case of a fuel injector known from DE 10 2007 060 395 A1, the nozzle needle has an end remote from the nozzle which is designed in the manner of a plunger and is arranged so as to act as a displacer in the control chamber. This control chamber communicates by way of an inlet restrictor with the high-pressure side of the fuel injector and can be connected by means of the control valve arrangement to the low-pressure side of the fuel injector. When the control valve arrangement is closed, the control chamber is connected only to the high-pressure side of the injector, whereas, when the control valve arrangement is open, the pressure in the control chamber falls owing to the additional connection which is then present between the control chamber and the low-pressure side. In this known fuel injector, the control chamber has an outlet duct which opens to the low-pressure side of a valve body and which is controlled by a sleeve-shaped closing body of the control valve arrangement. This sleeve-shaped closing body is arranged movably on a guide rod coaxial with the outlet duct, wherein the annular gap between the outer circumference of the guide rod and the inner circumference of the sleeve-shaped closing body is designed as a virtually leakage-free sealing gap. The sleeve-shaped closing body interacts with a seat concentric with the mouth of the outlet duct and is connected to an armature which, for its part, interacts with an electromagnet arrangement coaxial with the guide rod. If the electromagnet arrangement is electrically energized, the armature, together with the sleeve-shaped closing body, is pulled in the direction of the electromagnet arrangement, with the result that the closing body rises from its seat. In the electrically unenergized condition of the electromagnet arrangement, the closing body is set to the closing position thereof by a closing spring and the armature moves away from the electromagnet arrangement.

Fundamentally, the aim is to be able to determine accurately the operating phases of a fuel injector in order to allow optimum engine control. Wear phenomena on the fuel injector cause drift in the closing times of the nozzle needle, with the result that there is a corresponding change in the quantities of fuel injected and the engine concerned no longer operates in an optimum manner if adaptation of the fuel injector and the engine to the changed operating circumstances is not possible. Moreover, the injectors also exhibit series tolerances in the quantity injected, owing to unavoidable variation in components, even if each injector is activated in the same way.

SUMMARY OF THE INVENTION

It is the object of the invention to provide a fuel injector in which the closing times of the nozzle needle and hence the operating phases of the fuel injection system can be accurately determined.

For this purpose, the invention envisages assigning the control chamber a force or pressure sensor for detecting characteristic pressure changes during the closing and opening of the nozzle needle.

The invention makes use of the insight that the control chamber pressure changes significantly at the beginning and at the end of the injection phase of the fuel injector. Since the control chamber pressure is now recorded, the operating sequence of the fuel injector can be monitored with a high degree of precision. According to the invention, this is accomplished through a pressure measurement, which can be carried out relatively easily despite the small overall volume of a fuel injector. Detection of the stroke travel of the nozzle needle, which involves a high outlay in terms of design, is thus superfluous.

In an embodiment which represents a particularly preferred design, an outlet aperture of the control chamber on the low-pressure side of the fuel injector can be controlled by means of a sleeve-shaped closing body, which is arranged movably on a guide rod coaxial with the outlet aperture, and the guide rod is coupled at its end remote from the aperture to a pressure sensor arrangement. In this case, therefore, the tried and tested construction of a fuel injector known from DE 10 2007 060 395 A1, which was mentioned at the outset, is taken over in principle, wherein the guide rod is used to transfer the control chamber pressure to a force or pressure sensor arrangement.

It is advantageous here that the force or pressure sensor arrangement can be arranged away from the control chamber in the low-pressure fluid region of the fuel injector, thus allowing long-lasting insulation of the generally electrical elements of the force or pressure sensor arrangement to be achieved easily.

The invention furthermore offers the possibility of using the signals from the force or pressure sensor arrangement to determine the pressure of a high-pressure source for fuel associated with the fuel injectors, generally a common rail. It is advantageous here, on the one hand, that a hitherto customary separate pressure detection system at the high-pressure source can be omitted. Moreover, pressure detection with multiple redundancy is readily possible with the invention because engines with injection systems generally have a plurality of fuel injectors, and, as a result, the force or pressure sensors provided at the fuel injectors by the invention also make available a plurality of signal sources for pressure detection.

DETAILED DESCRIPTION

Figure 1:
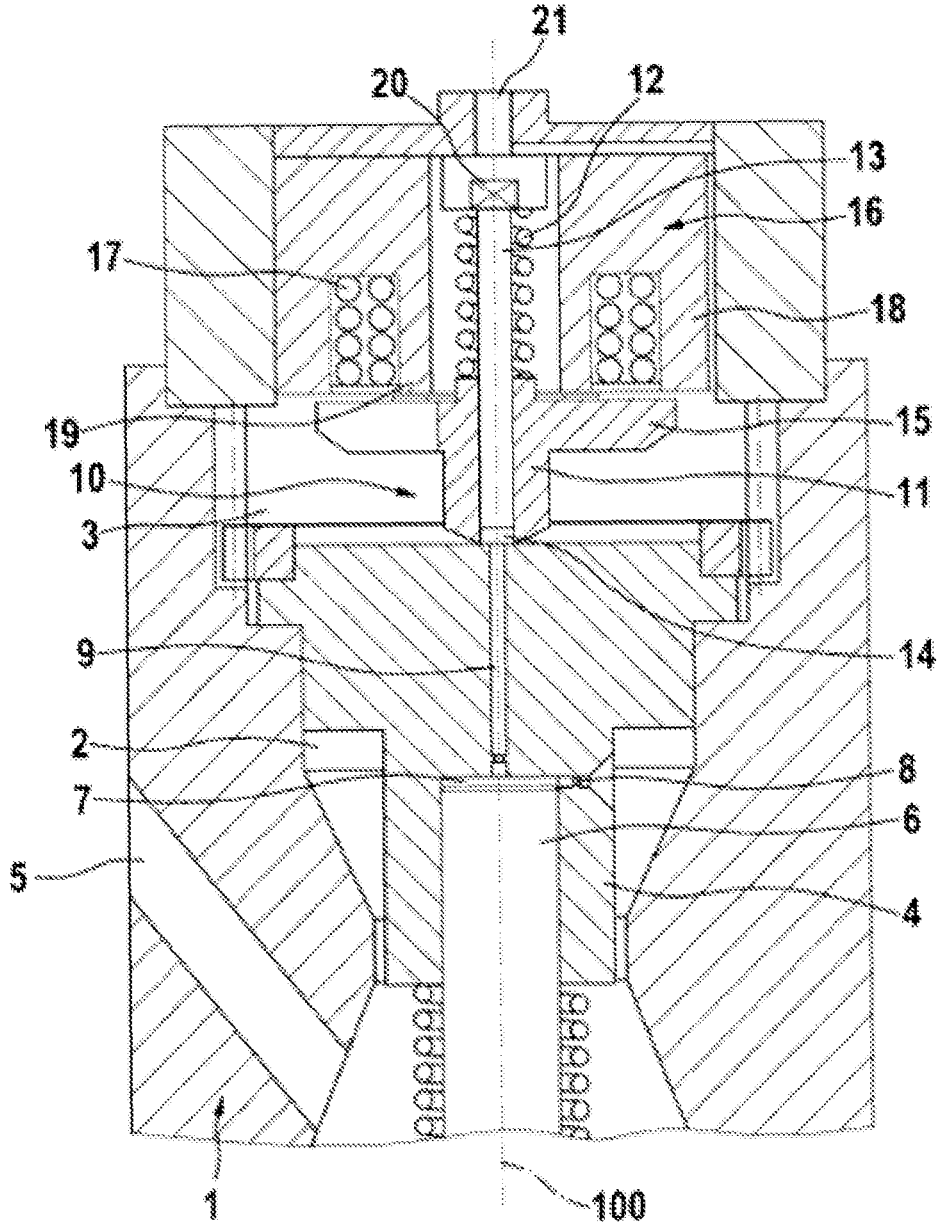
FIG. 1 shows a partial axial section of a fuel injector according to the invention.

According to FIG. 1, a high-pressure chamber 2 and a low-pressure chamber 3 are arranged within an injector body 1. These two chambers are separated from each other by a valve member 4.

The high-pressure chamber 2 communicates by way of an inlet duct 5 with a high-pressure source (not shown) for fuel, generally what is referred to as a common rail. The low-pressure chamber 3 is connected to a fuel tank or the like by a return line 21 or the like.

The high-pressure chamber 2 can be connected to the combustion chamber of an internal combustion engine (not shown) by injection nozzles (likewise not shown). The injection nozzles are controlled in a known manner by means of a nozzle needle, of which only the end remote from the nozzle, which is designed as a plunger 6, is illustrated in FIG. 1. The plunger 6 is arranged so as to act as a displacer in a control chamber 7 arranged in the valve member 4. This control chamber 7 communicates by way of an inlet restrictor 8 with the high-pressure chamber 2 and by way of a preferably restricted outlet duct 9 with the low-pressure chamber 3, wherein the outlet duct 9 is controlled by means of a control valve arrangement 10. When the outlet duct is shut off by means of the control valve arrangement 10 and the nozzle needle is in the closed position thereof, the same high pressure is established in the control chamber 7 as in the high-pressure chamber 2, with the result that the plunger 6 is pressed downward in FIG. 1 and the nozzle needle connected thereto is held in the closed position, in which the injection nozzles are shut off. If the outlet duct 9 is opened by means of the control valve arrangement 10, a reduced pressure is established in the control chamber 7 relative to the high pressure in the high-pressure chamber 2, and the plunger 6, together with the nozzle needle, moves upward in FIG. 1, i.e. the nozzle needle is set to the open position thereof and fuel is thus injected into the combustion chamber through the injection nozzles.

The control valve arrangement 10 has a sleeve-shaped closing body 11, which is clamped against a seat concentric with the outlet aperture of the outlet duct 9 by a closing spring 12, which is designed as a helical compression spring. In the example shown in FIG. 1, the seat is designed as a plane surface, on which the sleeve-shaped closing body 11 rests by means of a linear annular edge. In principle, however, it is also possible to provide a seat shaped in some other way.

The sleeve-shaped closing body 11 is guided in such a way that it can be moved axially on a guide rod 13 coaxial with the longitudinal axis 100 of the injector body 1, wherein the annular gap between the inner circumference of the closing body 11 and the outer circumference of the guide rod 13 is designed as a virtually leakage-free restriction or sealing gap. When the closing body 11 assumes the closed position illustrated in FIG. 1, the pressure chamber 14 formed within the closing body 11, which communicates by way of the outlet duct 9 with the control chamber 7 and then accordingly has the same fluid pressure as the control chamber 7, is shut off from the low-pressure chamber 3. Arranged on the closing body 11 is a star-shaped armature 15 of an electromagnet arrangement 16, which is provided as an actuator for actuating the control valve arrangement 10. In a known manner, this electromagnet arrangement 16 has a magnet coil 17, which is arranged within an electromagnet arrangement concentric with the guide rod 13 and having an annular outer pole 18 and an annular inner pole 19. If the magnet coil 17 is electrically energized, the armature 15 is attracted magnetically by the poles 18 and 19, with the result that the closing body 11 is raised from its seat against the force of the closing spring 12, and the control valve arrangement 10 is opened.

During the closed phase of the nozzle needle connected to the plunger 6, i.e. when the injection nozzles are closed, the control valve arrangement 10 is closed and the fluid pressures in the pressure chamber 14 and the control chamber 7 are the same. Immediately before the closing time of the nozzle needle, the pressure in the control chamber 7 falls below the high pressure in the inlet duct 5 owing to the pressure under the nozzle seat of the nozzle needle, which is low at this time, and the associated closing movement of the plunger 6. Immediately after the closure of the nozzle needle, the fact that the plunger 6 is now stationary leads to a steep rise in the pressure in the control chamber 7, wherein the control chamber pressure rises to the pressure in the inlet duct 5. The pressure in the control chamber 7 and the pressure in the pressure chamber 14, which is virtually identical therewith, are consequently at a pronounced minimum at the closing time of the nozzle needle.

Figure 2:
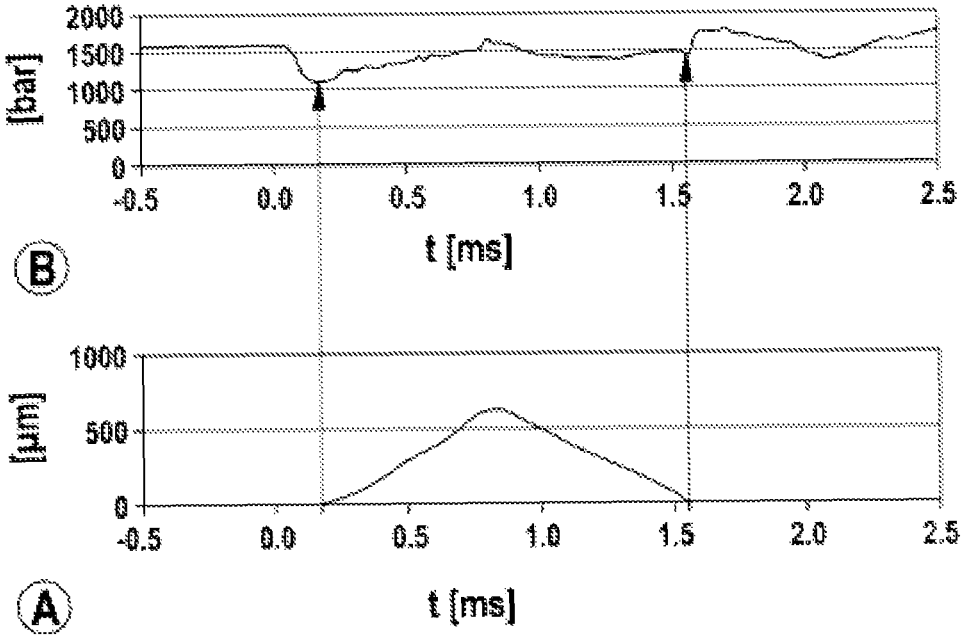
FIG. 2 shows diagrams which illustrate the time profile of the nozzle needle stroke and of the control chamber pressure.

By way of example, FIG. 2 shows the profile of the nozzle needle stroke in diagram A and the profile of the control chamber pressure in diagram B.

Since the pressure in the control chamber 7 with the closing body 11 closed is also present in the pressure chamber 14, the end of the control rod 13 within the closing body 11 is acted upon continuously by the control chamber pressure in this valve position. According to the invention, provision is now made to transfer the control chamber pressure by means of the guide rod 13 to a force or pressure sensor 20, illustrated schematically in FIG. 1, with the result that an evaluation circuit (not shown), which can be integrated into the engine controller and the input of which is connected to the force or pressure sensor 20, receives continuous information on the pressure in the control chamber 7 and thus "knows" the nozzle needle closing times, in particular.

In this design, the guide rod 13 thus has a dual function since, on the one hand, it guides the sleeve-shaped closing body 11 axially and, on the other hand, it serves as a force transmission element between the pressure chamber 14 or the control chamber 7 communicating therewith and the force or pressure sensor 20. Another advantage here is that the force or pressure sensor 20 is arranged in the low-pressure region of the fuel injector, in the example illustrated in the drawing close to the mouth of a return line 21 connecting the low-pressure chamber 3 to a relatively unpressurized fuel tank or the like. The force or pressure sensor 20 can expediently be designed as a piezoelectric element, at which an electrical voltage dependent on the contact pressure of the guide rod 13 can be picked off. Since the force or pressure sensor 20 can only be acted upon by fuel at low pressure, there are no difficulties with respect to the necessary electrical insulation, since conventional insulation materials are sufficiently resistant to fuels at low pressure. The situation is different with fuels at high pressure. In this case, there are no known insulation materials that are stable over the long term, and therefore subjecting an electrical element directly to fuel under high pressure is unacceptable over the long term.

As a departure from the embodiment illustrated, in which an electromagnet arrangement 16 is provided as an actuator, it is also possible to provide fuel injectors with different actuators. In particular, it would be possible to consider piezoelectric actuators, which can change length as a function of an applied electrical voltage.

In principle, the pressure or force sensors 20 can exploit any force- or pressure-dependent physical effects. For example, piezoelectric elements, at which an electrical voltage dependent on the external forces acting on the element can be picked off, are suitable.

Also possible and advantageous instead are piezoresistive elements, which exploit what is referred to as the piezoresistive effect, which consists in that the electrical resistivity of many materials changes under the action of compression or tension forces. Expressed more simply, piezoresistive elements are thus electrical resistors whose electrical resistance changes in accordance with external forces. In this context, reference may be made to silicon elements since the piezoresistive effect is relatively pronounced with this material.

Not only does evaluation of the measurement data from the force or pressure sensors 20 allow determination of the closing times of the nozzle needle, but the measured values also have a strong correlation with the fuel pressure in the inlet 5. Since the pressure in the inlet 5, for its part, is in turn determined by the pressure of the high-pressure fuel source of the injection system, generally a common rail, it is also possible to determine the respective operating pressure of the high-pressure fuel source from the measurement data of the sensors 20. This applies especially during the closing phase of the nozzle needle since, in this phase, fluid dynamic effects on the respective injector are at a minimum, i.e. the pressure prevailing in the control chamber 7 of the injector and hence also in the pressure chamber 14 very largely corresponds to the pressure of the high-pressure fuel source.

Since an internal combustion engine with an injection system generally has a plurality of cylinders or combustion chambers and accordingly has a plurality of injectors, the pressure or force sensors 20 of a corresponding number of fuel injectors are available, thus allowing the feed pressure of the fuel or of the high-pressure fuel source to be determined redundantly several times. At the same time, the conventional separate sensor system for pressure monitoring associated with the high-pressure fuel source can be omitted.

With appropriate data evaluation, an engine controller communicating with the force or pressure sensors 20 "knows" the opening and closing times of the nozzle needle and the respective pressure of the high-pressure fuel source of the injection system.

As a result, therefore, the injection system of an engine can be controlled in a particularly accurate way.

The invention claimed is:

1. A fuel injector having injection nozzles controlled by a nozzle needle and having a control chamber (7), which communicates with a high- and a low-pressure side of the injector, which is designed as a working chamber of a displacer (6) coupled to the nozzle needle for driving, and which is switched by means of a control valve arrangement (10) between a closing pressure, at which the nozzle needle is set to a closed position thereof by the displacer (6), and an opening pressure, at which the nozzle needle, together with the displacer (6), moves into an open position, characterized in that the control chamber (7) includes a force or pressure sensor (20) for detecting characteristic pressure changes during the closing and opening of the nozzle needle, in that an outlet aperture (9) of the control chamber (7) on the low-pressure side can be controlled by means of a sleeve-shaped closing body (11), which is arranged movably on a guide rod (13) coaxial with the outlet aperture (9), in that the guide rod (13) is coupled at an end remote from the aperture to the force or pressure sensor (20), and in that the force or pressure sensor (20) communicates on an output side with a signal evaluator or engine controller, which evaluates the sensor signals in order to determine closing times of the nozzle needle and the pressure of a high-pressure fuel source communicating with the fuel injector.

2. The fuel injector as claimed in claim 1, characterized in that the control valve arrangement includes an electromagnetic actuator (16).

3. The fuel injector as claimed in claim 2, characterized in that the actuator has a magnet coil (17), which is concentric with the guide rod (13) and has annular inner and outer poles (18, 19).

4. The fuel injector as claimed in claim 3, characterized in that a star-shaped armature (15), which interacts with the inner and outer poles (18, 19), is arranged on the closing body (11).

5. The fuel injector as claimed in claim 1, characterized in that the end of the guide rod remote from the aperture acts upon a piezoelectric force or pressure sensor (20).

6. The fuel injector as claimed in claim 1, characterized in that the force or pressure sensor (20) is arranged on the low-pressure side.

7. The fuel injector as claimed in claim 6, characterized in that the force or pressure sensor is arranged at an inlet of a return line (21) which is relatively unpressurized.

8. The fuel injector as claimed in claim 1, characterized in that a piezoresistive sensor is provided as the force or pressure sensor (20).

* * * * *